US005322175A

United States Patent [19]

Nobili

[11] Patent Number: 5,322,175

[45] Date of Patent: Jun. 21, 1994

[54] SEPARATING DEVICE FOR HOLDING DISPLAY UNITS IN PARALLEL POSITION

[75] Inventor: Renato Nobili, Correzzana, Italy

[73] Assignee: Sarno S.N.C. di Nobili Renato & C., Barzano, Italy

[21] Appl. No.: 960,716

[22] Filed: Oct. 14, 1992

[30] Foreign Application Priority Data

Oct. 23, 1991 [IT] Italy ..... MI91U 000928

[51] Int. Cl.[5] ..... A47F 5/00

[52] U.S. Cl. ..... 211/183; 211/59.1

[58] Field of Search ..... 211/183, 59.1, 57.1, 211/54.1, 59.4; 248/220.4, 220.3, 221.1

[56] References Cited

U.S. PATENT DOCUMENTS 3,189,185 6/1965 Grasso ..... 211/59.1
4,058,220 11/1977 Torongo .
4,217,986 8/1980 Brown ..... 211/57.1
4,869,376 9/1989 Valiulis et al. ..... 211/59.1
5,114,021 5/1992 Fredrickson ..... 211/59.1 X

*Primary Examiner*—Alvin C. Chin-Shue
*Assistant Examiner*—Sarah A. Lechok
*Attorney, Agent, or Firm*—Herbert Dubno

[57] ABSTRACT

A separating device for holding in parallel position object display cards suspended in a sliding manner from a support bracket located in an inclined position relative to the horizontal, consisting of at least one flat rectilinear component capable of being attached perpendicularly to the upper part of a display card in order to project from surface of the card carrying the product to be displayed and being of length substantially equal to the projection of the product from the surface of the card, the flat rectilinear component removably attached for press-fitting to the upper end of the card, and of a transverse slot and central vertical notch supporting and guiding the card sliding on brackets of "inverted T" section and the like.

8 Claims, 1 Drawing Sheet

SEPARATING DEVICE FOR HOLDING DISPLAY UNITS IN PARALLEL POSITION

FIELD OF THE INVENTION

This invention is related to a separating and distance-regulating device capable of holding in a constant and parallel relative position a multiplicity of units suspended from a bracket and sliding freely thereon, in particular, display cards for objects and products intended for the retail trade.

BACKGROUND OF THE INVENTION

As is known, many types of objects such as, for example, cosmetics in cases, boxes, bottles and like small-size objects are displayed in department stores and in many shops and are suspended from a rectilinear, horizontal or inclined bracket, in order to facilitate selection and removal by buyers without requiring the intervention of the sales staff. Such objects are normally packed by attaching them to a backing card made of cardboard or rigid plastic, at the top of which is provided a hole or a slot located crosswise which enables it to be hooked onto the support bracket usually made of metal. On each bracket are suspended several backing cards carrying the same type of object or product.

To facilitate viewing of the suspended products, each object is secured to the backing card either by stapling or, more frequently, by a transparent plastic film which covers the object and is then attached peripherally, normally by hot-welding, to one of the surfaces of the backing card.

Such display cards, normally termed "blisters" because of the particular "swollen" projection presented by the object in relation to the flat card, have a disadvantage, an unwelcome one from a practical and aesthetic viewpoint, which is when the object is attached to a surface of the backing card, the weight of the object is unbalanced in relation to the card thus causing, when the card is suspended in a sliding manner on a bracket, and in particular on a bracket inclined downward, toward the area of removal, lateral rotation of the display card relative to the vertical is noticed and which prevents the card from sliding freely along the bracket in order to reach a position facilitating removal following detachment of the previous card. Furthermore such rotation, in occurring with all the cards suspended from the bracket, imparts an undesirable aesthetic effect and hampers removal. Such difficulty in sliding is even more marked in the case of flat cards provided with an elongated slot hooked onto the leg of an "inverted T" rod, because of greater wear caused by the larger surfaces in contact compared with those presented by cylindrical holes hooked onto a cylindrical bracket.

OBJECTS OF THE INVENTION

There is therefore an object of the present invention to provide a device which is capable of overcoming the disadvantages of the known devices and, in particular, to overcome the lack of parallelism and vertical positioning presented by "blister" type and like display cards. One other object of the present invention is to provide a separator-spacer for such display cards which is capable of ensuring correct sliding of the cards on brackets of any type and to provide setting, and constant parallelism thereof in relation to a vertical plane, and therefore also in relation to one another irrespective of the angle of inclination of the support bracket without creating difficulties for attachment and for removal by buyers.

Yet another object of the invention is to provide a separator applicable to or capable of being made as a single unit with any type of backing card provided with a hole or slot or even not provided therewith at all, and regardless of the constituent material of the card, i.e., plastic, cardboard or the like.

Such objects summary of the invention are advantageously achieved by a separating device for holding display cards in parallel position relative to one another and in a perpendicular direction object-display cards suspended in a sliding manner from an inclined support bracket or supported by being attached thereto. The device comprises at least one flat rectilinear component capable of being attached perpendicularly to the upper part of a display card in order to project from the surface of the card carrying the product to be displayed and being of length substantially equal to or greater than the projection of the product from such surface of the card. Such flat rectilinear component provides means of attachment by press-fitting to the upper end of such backing card, as well as means consisting of a transverse slot and a central vertical notch to support and guide the card sliding on "inverted T" and like rods. The flat rectilinear component is designed in such a way as to act as a spacer capable of holding the individual cards suspended from such bracket inclined downward at the front end, in an equidistant position and parallel to one another by causing the free end of the flat component of each card to bear on the immediately preceding card. More particularly, the means of attachment integral with the spacer includes a flat component provided with a groove or channel on the lower part thereof capable of acting as a press-fitting or like location for the flat upper part of the card, and on the upper part, above the spacer, with an ordinary transverse slot having a central vertical notch.

BRIEF DESCRIPTION OF THE DRAWINGS

Further objects, features and advantages of this invention will become more clearly apparent from the following description, reference being made to the attached drawings in which.

SPECIFIC DESCRIPTION

Figure 3:
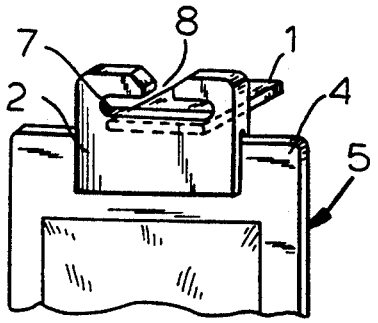
FIG. 3 is a component of FIG. 1 snapped and pressed onto a flat card for objects to be displayed for sale.
Figure 6:
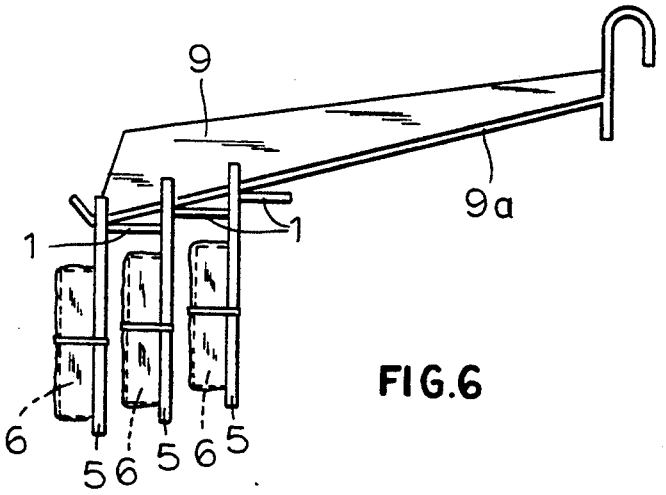
FIG. 6 is a series of flat product-display cards, all provided with the spacer forming the object of the invention and suspended from an inclined "inverted T" bracket.
Figure 4:
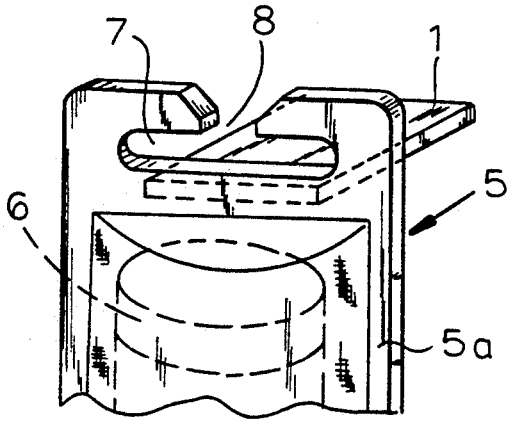
FIGS. 4 and 5 are two different method of implementation of the device according to the invention.

With reference to the above-mentioned figures, the separating device in question comprises, according to an initial method of implementation, a flat rectilinear component 1 made of plastic, cardboard or like material, attached to (or made as a single unit with) a prismatic body 2, likewise of flat shape (FIG. 1), on the lower part of which, from the bottom end, is provided a quadrangular groove 3 designed in such a way as to accommodate with light forcing action part of the upper end 4 (FIG. 3) of an ordinary card 5 carrying on a surface 5a (FIG. 6) an object 6 retained by an envelope consisting of a transparent plastic film, as illustrated in FIGS. 4 and 6.

At the top of such flat spacer 1 is provided, as in known display cards, a transverse slot 7 with a central vertical notch 8 to be hooked in a sliding manner onto an "inverted T" support bracket 9, inclined as illustrated in FIG. 6.

Body 2 thus made is hooked astride card 5 (FIG. 3) until the bottom of groove 3 bears on the edge of upper end 4 of the card. To ensure stable engagement between the groove and end 4, there may be provided inside the said groove projecting shoulders 10–10a or transverse knurls capable of allowing partial flexible opening of the surfaces of groove 3 during insertion of end 4 thus ensuring a sufficiently stable attachment (FIG. 2).

Figure 1:
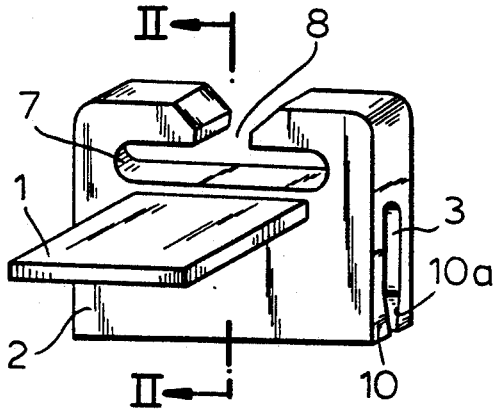
FIG. 1 is an axonometric view of a spacer made according to the invention.
Figure 2:
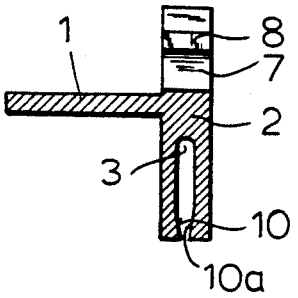
FIG. 2 is a transverse median section drawn according to line II—II of FIG. 1.

The device shown in FIG. 1 and 2 may therefore be attached to a backing card both where the latter is not provided with slot 7 and relevant notch 8 and where such slot is present; in this second case, body 2 may likewise be attached to end 4 of the card until it covers the slot and holds such slot above the said card, as illustrated in FIG. 3.

According to another method of implementation, such flat spacer 1 may be made as a single unit with (or alternatively attached to) the card 5 already provided with slot 7 and notch 8. In this case such spacer is positioned immediately below slot 7 (FIG. 4).

Figure 5:
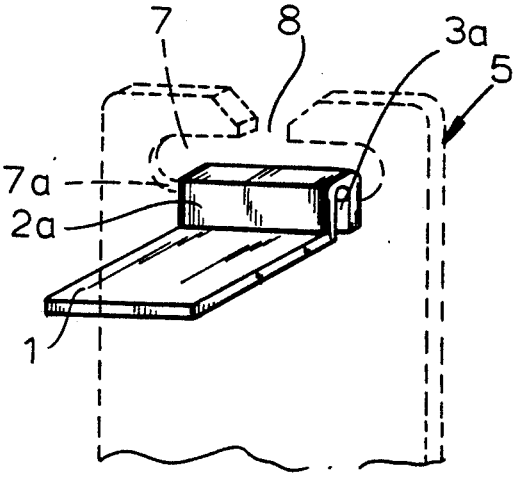

Furthermore, where cards 5 are already provided with slot 7 and notch 8 (FIG. 5), the spacer forming the object of the invention may be made with a body 2a with lower attaching groove 3a but devoid of slot 7 and notch 8.

In this case, body 2a is attached to the lower end 7a of slot 7 in order to provide such slot 7 with sufficient clearance to allow sliding of the card on the "T" rod, and more precisely on leg 9a of rod 9, as illustrated in FIG. 6.

In all of the cases described above, spacer 1 is made according to a length or projection such that, as shown in FIG. 6, each backing card 5 suspended from rod 9 may be maintained equidistant from the other cards and be located parallel to them and in a vertical direction due to the effect of the free end of each spacer 1 bearing on the preceding card from the free end of the support rod.

Accordingly, each backing card may, after the card preceding it has been removed, remain in perpendicular position (thus facilitating the sliding thereof toward the front end of the rod) by the effect of the said flat component 1 which, in remaining with its end in contact with the base of rib 9a of rod 9, always holds the card in a vertical position.

Obviously the form, dimensions, materials used and colours of the various components of the device described above may vary in keeping with application requirements and with the dimensions of the display cards and the relevant objects carried thereon, without thereby departing from the scope of protection of the invention.

I claim:

1. A display comprising:

a support bracket having an inverted T-shaped cross section and inclined downwardly with respect to the horizontal toward a front end of the bracket; and a plurality of display cards suspended in succession on said support bracket, each of said cards being formed with:

a respective bearing face carrying a product to be displayed said product projecting from the bearing face by a certain distance, a respective transverse slot formed parallel to a top edge of said bearing face;

a respective notch formed centrally on the top edge and opening outwardly, running into the respective transverse slot and receiving slidably an upright portion of said support bracket, and a respective flat and generally rectilinear component extending perpendicular to said bearing face from an opposite face of the card and of a length at least substantially equal to certain said distance and spacing said display cards equidistantly from one another in respective parallel planes upon suspending said cards on said support bracket with respective rectilinear components bearing against bearing faces of adjacent display cards.

2. The display defined in claim 1 wherein each rectilinear component is provided with a mounting body engaging a respective card face, the body having a downwardly open U-shaped cross section fitting over an edge of the transverse slot.

3. The display defined in claim 1 wherein said bracket is formed with a base engaged slidably by the slot of said card and extending therealong, said upright portion extending generally perpendicular to the base and being received between respective vertical surfaces of the notch.

4. A display comprising:

a support bracket having an inverted T-shaped cross section and inclined downwardly with respect to a horizontal toward a front end of the bracket; and a plurality of display cards suspended in succession on said support bracket and formed with respective display surfaces carrying respective products to be displayed and projecting from the display surfaces by a certain distance; and respective attaching bodies removably mounted on said display cards for suspending the latter on said support bracket, each of said attaching bodies comprising:

a first flat face, an opposite flat face, a bottom and a top, a transverse slot formed adjacent the respective top, a notch formed centrally vertically on the respective top and opening upwardly and running into the respective transverse slot, a respective flat rectilinear component formed between respective top and bottom on a respective first flat face and extending generally perpendicular therefrom with a length at least substantially equal to said certain distance, and means in each body forming a groove opening at the respective bottom and extending upwardly between the respective first and opposite flat faces toward but terminating below the respective top and pressfittingly receiving a respective upper portion of a respective display card, said support bracket having an upright portion slidably received in the transverse slots of the display cards, the rectilinear flat components spacing said display cards equidistantly from one another in respective parallel planes by bearing against respective opposite faces of following cards upon suspending said bodies on said support bracket.

5. The display defined in claim 10 wherein the flat rectilinear component is formed integrally with the first face and located immediately below the transverse slot.

6. The display defined in claim 10 wherein the groove is formed with:

a pair of inner faces, and inwardly projecting elements formed on each of the inner faces and adapted to enhance adherence between the inner faces and respective surfaces of the display card received by the groove.

7. The display defined in claim 10 wherein the support bracket is formed with a base received slidably by the transverse slot and extending therealong and with an upright portion, the notch being formed with vertical surfaces facing one another and flanking the upright portion upon suspending the body on said bracket.

8. A display comprising:

a support bracket having an inverted T-shaped cross section and inclined downwardly with respect to the horizontal toward a front end of the bracket; and a plurality of display cards suspended in succession on said support bracket, each of said cards being formed with:

a respective bearing face carrying a product to be displayed and projecting from the bearing face by a certain distance, a respective transverse slot formed parallel to a top edge of said bearing face;

a respective notch formed centrally on the top edge and opening outwardly and running into the respective slot receiving slidably an upright portion of said support bracket, and a respective flat and generally rectilinear component extending perpendicular to said bearing faces from an opposite face of the card and of a length at least substantially equal to said certain distance and provided with a mounting body engaging a respective card face, the body having a downwardly open U-shaped cross section fitting over an edge of the transverse slot, so that said rectilinear component bears against said bearing faces of adjacent display cards and spaces said display cards equidistantly from one another in respective parallel planes upon suspending said cards on said support bracket.

* * * * *